United States Patent [19]

Hirsch et al.

[11] Patent Number: 4,938,235

[45] Date of Patent: Jul. 3, 1990

[54] SEPARATOR FOR SEPARATING TOBACCO PARTICLES FROM A TOBACCO/GAS MIXTURE

[75] Inventors: Werner Hirsch, Hamburg; Arno Weiss, Norderstedt, both of Fed. Rep. of Germany

[73] Assignee: B.A.T. Cigarettenfabriken GmbH, Hamburg, Fed. Rep. of Germany

[21] Appl. No.: 226,025

[22] Filed: Jul. 29, 1988

[30] Foreign Application Priority Data

Jul. 29, 1987 [DE] Fed. Rep. of Germany ..... 3725148
Jun. 15, 1988 [EP] European Pat. Off. ..... 88109550.9

[51] Int. Cl.[5] ..... A24B 3/00; A24B 3/06

[52] U.S. Cl. ..... 131/110; 131/296; 131/109.2

[58] Field of Search ..... 131/296, 110, 109.2

[56] References Cited

U.S. PATENT DOCUMENTS 4,407,306 10/1983 Hibbitts ..... 131/296
4,844,101 7/1989 Hirsch et al. ..... 131/296

FOREIGN PATENT DOCUMENTS 0029588 6/1981 European Pat. Off. ..... 131/296
0639871 11/1934 Fed. Rep. of Germany ..... 131/296
3246513 12/1981 Fed. Rep. of Germany ..... 131/296
3619816 12/1986 Fed. Rep. of Germany ..... 131/296

*Primary Examiner*—V. Millin
*Attorney, Agent, or Firm*—Armstrong, Nikaido, Marmelstein, Kubovcik & Murray

[57] ABSTRACT

A separator for separating tobacco particles from a tobacco/gas mixture comprises a hood, a circular deflection space disposed in the hood, an inlet for the tobacco/gas mixture to be separated opening tangentially into the circular deflection space, a downwardly directed outlet in the deflection space for the tobacco particles, an outlet for the tobacco particles at the lower end of the hood, and an outlet for the gas above the deflection space. The deflection space is formed by an upwardly closed and downwardly open cylinder; the gas is withdrawn from the hood above the deflection space; the size ratio of the area of the deflection space to the area of the inlet lies between 5 and 30; and the size ratio of the area of the hood to the area of the inlet is greater than 50.

18 Claims, 6 Drawing Sheets

Tobacco mass flow:1.500 kg/h
Gas (steam) mass flow:500 kg/h

SEPARATOR FOR SEPARATING TOBACCO PARTICLES FROM A TOBACCO/GAS MIXTURE

BACKGROUND OF THE INVENTION

Field of the Invention

The invention relates to a separator for separating tobacco particles from a tobacco/gas mixture comprising a hood, a circular deflection space arranged in the hood, an inlet for the tobacco/gas mixture to be separated opening tangentially into the circular deflection space, a downwardly directed outlet in the deflection space for the tobacco particles, an outlet for the tobacco particles at the lower end of the hood, and an outlet for the gas above the deflection space.

In the course of tobacco processing, in particular, however, in the treatment of expanded tobacco, the production of which is apparent for example from U.S. Pat. No. 4,844,101, the tobacco particles must be separated from the produced tobacco/gas mixture. In particular for the expansion of tabacco steam or vapour is often used, and consequently hereinafter the term "gas" is intended to cover vaporous media as well.

The basic principles of particle separation by mass forces will be found, for example, in "*Ullmanns Enzyklopaedie der Technischen Chemie*", 4th edition volume 2, Process Technology I. Such "separators" have also already been used in the tobacco industry. Thus, German Offenlegungsschrift No. 3.619,816 discloses an apparatus for expanding tobacco which includes, apart from a cyclone dust separator, a separator having a mesh screen. The mesh screen permits the passage of the steam/air mixture to an outlet tube which supplies it to the cycle again, whilst the tobacco particles are led downwardly to an air lock.

European patent application No. 29,588 discloses a method for heating tobacco impregnated with an expansion agent in which the expanded-tobacco-containing gas is separated from the tabacco particles by means of a tangential separator.

A separator as acknowledged above for separating dust particles from a gas is disclosed in German patent specification No. 639,871. In this case to the inlet an annular passage is connected from the bottom of which several passages lead downwardly in helical windings turning in the same direction as the crude gas supply conduit and terminating with gradual translation at the chamber wall into a chamber disposed beneath the annular passage; the radius of curvature of these passages is smaller than the radius of the hood.

This is thus an embodiment of a centrifugal force separator in which the mixture streams must be conveyed with relatively high speed to obtain the desired separation caused by the change of movement on passing through the curved passages.

A disadvantage here is the relatively great constructural requirements needed for the apparatus for the necessary high transport speed both in the inlet and in the deflection space and finally in the hood; moreover, for satisfactory operation of this separator it is absolutely essential for all areas coming into contact with the dust/gas mixture, in particular the helically curved passages, to be kept carefully clean because depositions on the walls thereof, in particular encrusted particles, immediately lead to impairment of the separation efficiency. Finally, the lower end of the hood must be kept closed, for example, by a rotary vane lock to ensure the necessary high conveying speeds. There are, however, many used where the operation can or must be carried out with an open outlet.

SUMMARY OF THE INVENTION

The invention is therefore based on the object of providing a separator of the type indicated in which the aforementioned disadvantages do not occur.

In particular, a separator is to be proposed which in constructionally simple manner permits the satisfactory separation of gas/tobacco particles with relatively small conveying speeds.

This is achieved according to the invention by a separator comprising a hood, a circular deflection space arranged in the hood, an inlet for the tobacco/gas mixture to be separated opening tangentially into the circular deflection space, a downwardly directed outlet in the deflection space for the tobacco particles, an outlet for the tobacco particles at the lower end of the hood, and an outlet for the gas above the deflection space, in which the deflection space is formed by an upwardly closed and downwardly open cylinder, wherein the gas is withdrawn from the hood above the deflection space, wherein the size ratio of the area ($A_2$) of the deflection space to the area ($A_1$) of the inlet is between 5 and 30, and wherein the size ratio of the area ($A_3$) of the hood to the area ($A_1$) of the inlet is greater than 50.

Expedient embodiments will be apparent from the features of the subsidiary claims.

The advantages achieved with the invention are based on the specific configuration of a centrifugal force separator whose deflection space is formed by a simple upwardly closed and downwardly open cylinder which is disposed in another container, hereinafter referred to as "hood", so that the gas phase emerging downwardly from the deflection space is withdrawn upwardly over the entire effective flow cross-section of the hood whilst the tobacco particles fall freely downwardly out of the deflection space and out of the hood.

The horizontal flow cross-section of the hood must be made so large that the vertical flow velocity of the gas phase is always less than the sinking velocity of the tobacco particles to be separated, i.e. the overall system must be designed taking account of the maximum gas stream to be expected on the one hand and the minimum sinking speed of the tobacco particles to be expected on the other hand.

To ensure these conditions the size ratio of the area of the deflection space to the area of the inlet must lie in the range of 5 to 30; at the same time, the size ratio of the area of the hood to the area of the inlet must be greater than 50, in particular greater than 100.

At the inlet of said separator the usual velocities necessary for pneumatic transport of the mixture tobacco/-gas in the region of about 20 m/s occur whilst the gas discharge velocity at the upper end of the hood is in the range of about 0.1 to 0.2 m/s.

The necessary pneumatic transport of the mixture terminates practically at the wall of the deflection space because there the tobacco particles fall freely downwardly under the action of gravity whilst the gas is withdrawn upwardly from the hood by a suction means disposed above the deflection space.

If the separator is operated so that at the lower end of the hood approximately ambient pressure prevails the hood can be opened downwardly, i.e. the separator can be operated without a discharge means prone to trouble, in particular soiling.

In contrast to conventional separators, i.e. cyclones or tangential separators, fluctuating throughput rates of the gas and/or tabacco phase do not have any appreciable influence on the degree of separation because with the open separator described here only a greater or lesser amount of secondary air is sucked in upon a change of the throughput rate, i.e. the vertical flow velocity of the gas phase remains approximately constant.

This makes separation of the tobacco particles from the tobacco/gas mixture possible even without using a rotary vane lock, due to the insensitivity explained of the separator to secondary air. Since in contrast to cyclones or other conventional tangential separators the gas phase can be sucked off at the greatest cross-section of the hood, the flow is made uniform and the separator relatively very insensitive to the operating parameters.

If, however, in the overall system an inner excess pressure or reduced pressure exists, the hood must be closed at the bottom by a discharge means, generally a rotary vane lock or a discharge screw.

With a closed separator the degree of separation improves with decreasing gas phase because in this case the difference between the vertical flow velocity of the gas phase and the sinking velocity of the tobacco particles becomes greater.

Even if tobacco/gas mixtures causing considerable soiling are to be processed, the degree of separation is only slightly impaired and consequently no excessive demands need be made on the corresponding tobacco preparation.

The inevitable encrustations at the inner faces of the inlet, deflection space and hood also influence the separation efficiency only slightly and consequently the hitherto usual very careful cleaning need only be carried out at greater intervals of time.

Furthermore, it is now also possible to separate several tobacco/gas mixtures in one separator simply by connecting the various two-phase streams to be separated with each other.

Because of the low flow velocity occurring in the separator only a low pressure loss occurs so that in this respect as well the method can be carried out with reduced energy consumption.

To achieve a uniform flow velocity over the hood cross-section as necessary for homogeneous separation of the tobacco particles, in the upper region of the hood a flow resistor is arranged which as a rule consists of a perforated metal sheet with holes distributed over the sheet surface.

To prevent tobacco particles from being entrained into the extraction conduit for the gas a sieve or filter may be arranged beneath the flow resistor; it is alternatively possible to construct the flow resistor itself as sieve or filter.

To facilitate cleaning of the separator an opening closeable by a door may be provided in the hood and/or the deflection space permitting access to the interior of the hood or of the deflection space.

If the gas phase contains steam or vapour or other condensing components then in a preferred embodiment the wall of the hood is provided with a heating means to prevent condensation and resulting soiling of the walls.

Finally, it is also possible to arrange a plurality of deflection spaces adjacent each other in a hood and thereby connect a plurality of tobacco/gas mixture to be separated with each other, one gas and one tobacco particle stream being produced in each case.

BRIEF DESCRIPTION OF THE DRAWINGS

The invention will be explained in detail hereinafter with reference to examples of embodiment with the aid of the attached schematic drawings, wherein.

DESCRIPTION OF THE PREFERRED EMBODIMENTS

Figure 1:
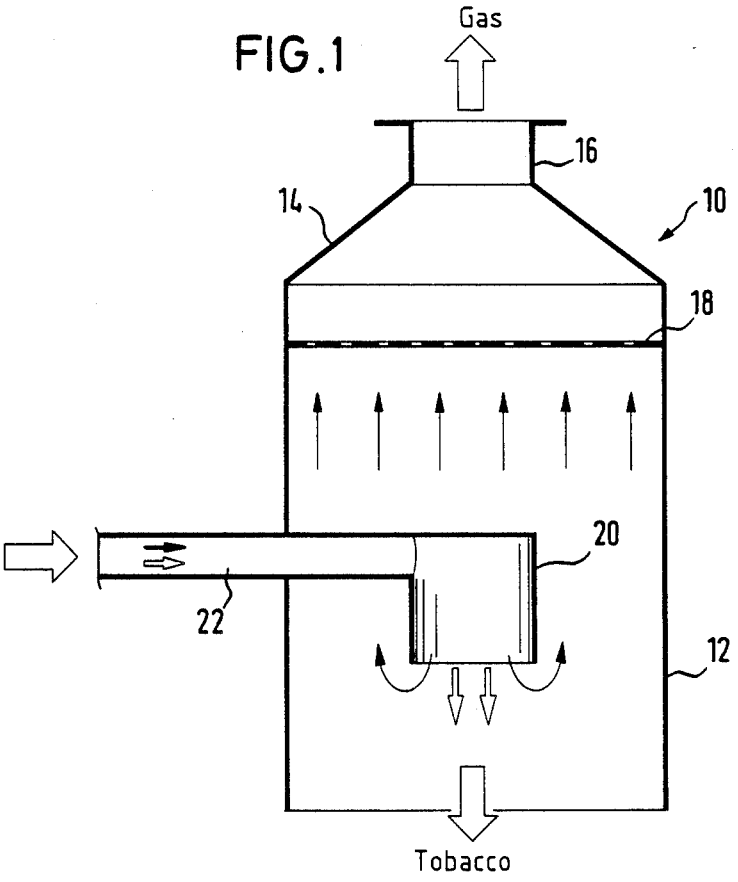
FIG. 1 is a vertical section through a first embodiment of a separator.
Figure 2:
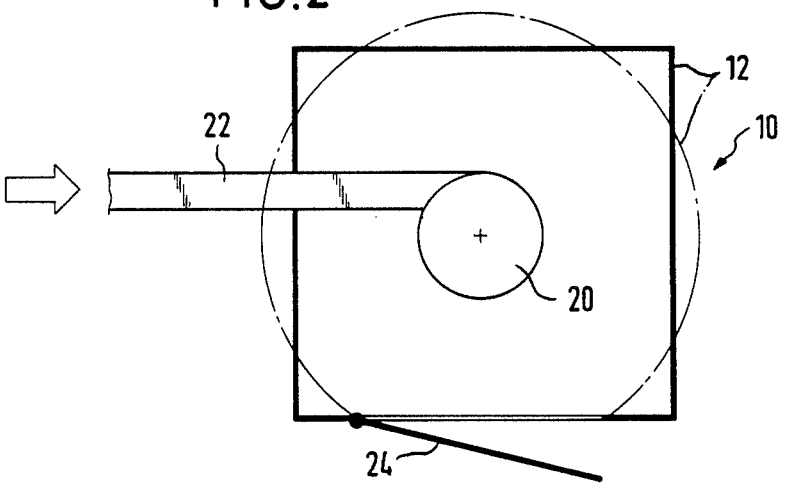
FIG. 2 is a horizontal section through the separator according to FIG. 1.

The separator shown in FIGS. 1 and 2 and denoted generally by the reference numeral 10 comprises a vertically arranged downwardly open hood 12 which has a regular cross-section; as apparent from FIG. 2 this cross-section has a generally rectangular, in particular square, form or alternatively a circular form as indicated by the dot-dash lines. The door 24 serves to facilitate inspection and cleaning of the separator 10.

At its upper end hood of the separator 10 is provided with an outlet hopper 14 having a discharge opening 16 which has a smaller cross-section than the hood 12. Connected to the outlet opening 16 is a fan (not shown).

Disposed in the hood 12 is a vertically arranged downwardly open circuit deflection space 20 to which via a transport conduit 22, generally a transport pipe, the two-phase mixture to be separated is supplied, that is, the tobacco/gas mixture. The transport direction is indicated by the large arrow whilst the flows of the two phases of the tobacco/gas mixture in the conduit 12 are indicated by the two different arrows. In this context "circular" means curved and for example, but not necessarily, round.

The transport conduit 22 opens tangentially into the deflection space 20 which has circular cross-section and as a rule is formed as vertically disposed cylinder closed at the top and open at the bottom.

The tobacco/gas mixture arriving from the conduit 22 contacts the inner wall of the deflection space 20 tangentially and is guided along a helical path along the inner wall of the deflection space 20 with simultaneous retardation to the lower opening of the deflection space 20.

On discharge downwardly out of the deflection space 20 the tobacco particles fall downwardly as indicated by the arrows whilst the lighter phase, that is the gas, is sucked off upwardly by means of the fan and emerges from the outlet opening 16 of the hood 12.

To obtain a uniform flow velocity over the cross-section of the hood 12 in the upper region of the latter, i.e. somewhat beneath the hopper 14 but above the deflection space 20, a flow resistor 18 is arranged which consists of a perforated sheet metal with holes distributed uniformly over its area.

If the tobacco/gas mixture is supplied to the separator 10 with adequate pressure the hood 12 can be open at the bottom as can be seen in FIG. 1, i.e. in this case the separator 10 can be operated without a trouble-prone, in particular soiling-prone, discharge means for the separated tobacco particles.

If, however, in the separator or in the overall system an inner excess pressure or reduced pressure prevails, then the hood 12 must be closed downwardly by a discharge means. In the embodiment according to FIG. 3 this discharge means is formed by a rotary vane lock 28 which is disposed in the outlet opening in the funnel-shaped lower region 26 of the hood 12.

Figure 3:
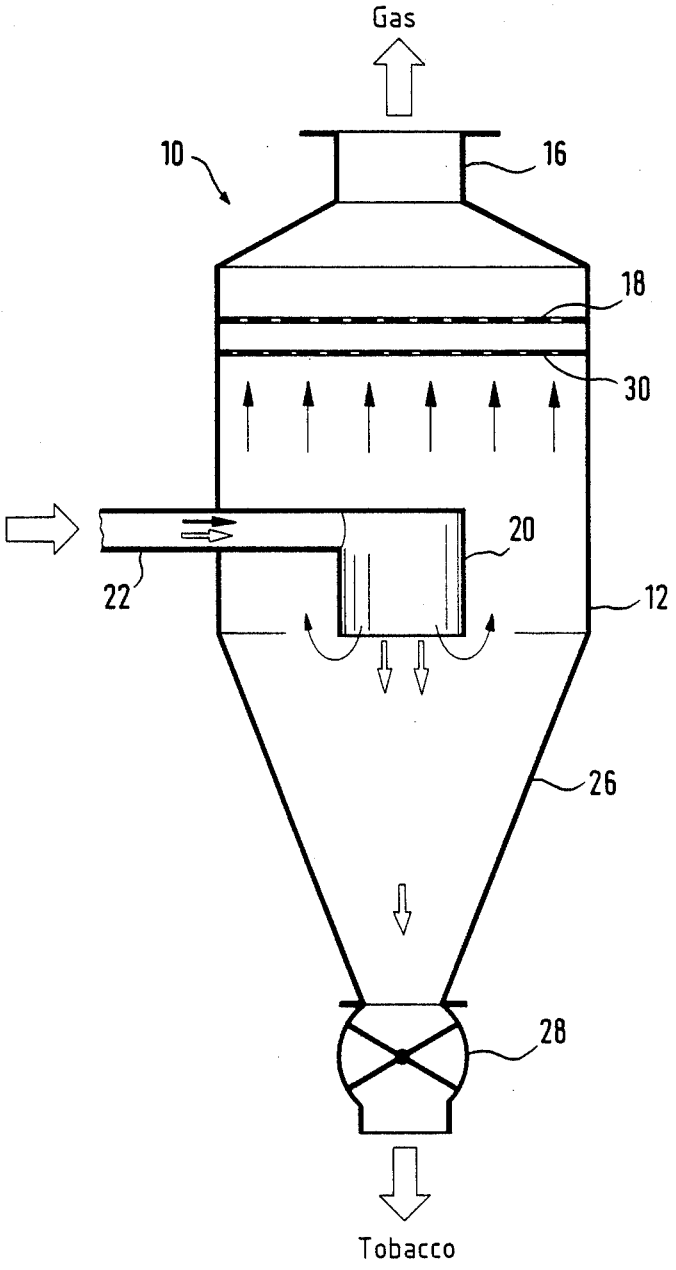
FIG. 3 is a vertical section through another embodiment of the separator.

The embodiment of FIG. 3 also differs from the embodiment according to FIGS. 1 and 2 in an additionally provided screen or sieve 30; said sieve 30 is disposed in the hood 12 between the deflection space 20 and the flow resistor 18 and preventsentraining of tobacco particles into the extraction conduit connected to the outlet 16.

The horizontal flow cross-section of the hood 12 must be made large enough to ensure that the vertical flow velocity of the gas phase is always less than the sinking velocity of the tobacco particles to be separated, i.e. the separator 10 must be designed taking account of the greatest gas stream to be expected on the one hand and the smallest sinking velocity of the tobacco particles to be expeeted on the other.

Figure 4:
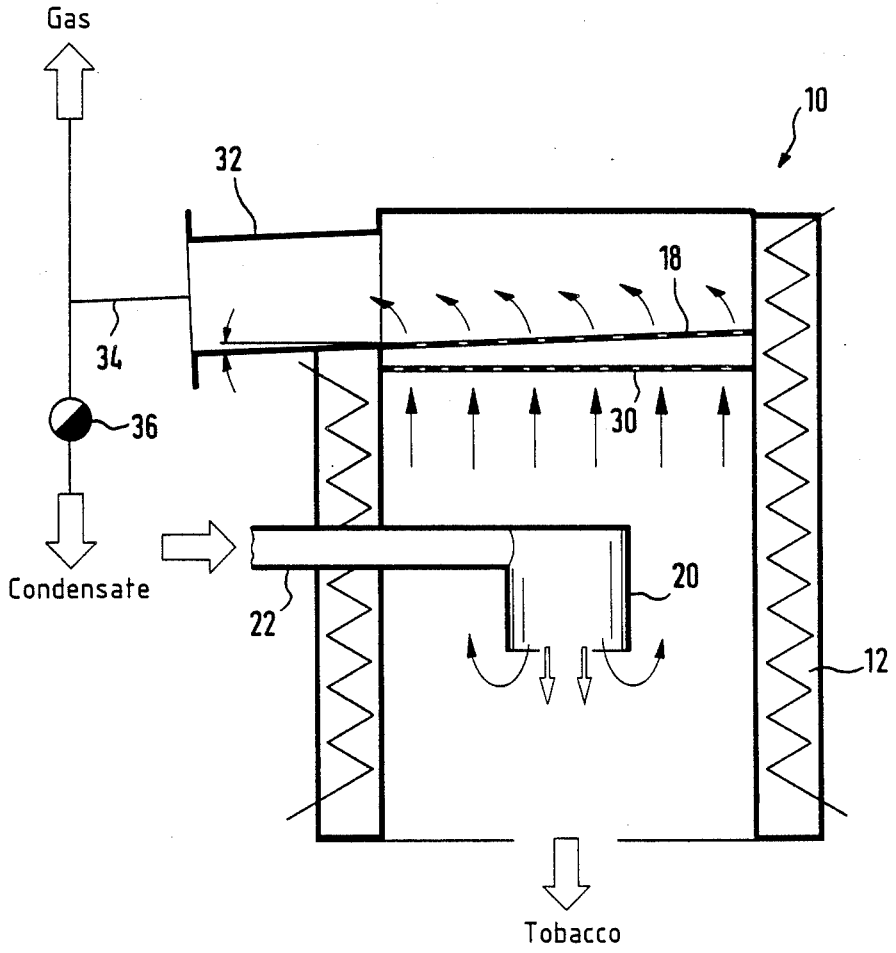
FIG. 4 is a vertical section through a further embodiment of the separator.

FIG. 4 shows an embodiment of a separator 10 which can be used when the gas phase consists of steam or vapour or contains condensing components. In this case the walls of the hood 12 should be provided with a heating means to prevent condensation and the resulting contamination of the walls. The heating means is indicated in the wall of the hood 12 by the zig-zag line.

At the upper end of the hood 12 the gas phase consisting of steam or vapour or containing condensing components is withdrawn according to the illustration in FIG. 4 to the left and supplied to an exit connecting piece 32 which is inclined somewhat downwardly in the discharge direction with respect to the horizontal so that the condensate forming there collects at the bottom of the exit connecting piece 32 and can be withdrawn via a conduit 34.

At the end of the conduit 34 a separation of this phase into the downwardly emerging condensate on the one hand and the gas on the other is effected.

Otherwise this embodiment has the construction already described and therefore need not to be described again.

Figure 5A:
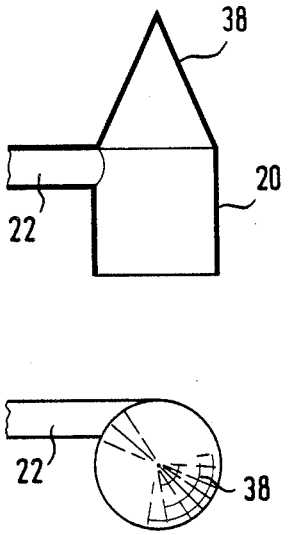
FIG. 5*a* is a vertical section and a plan view of a modification of the deflection space.
Figure 5B:
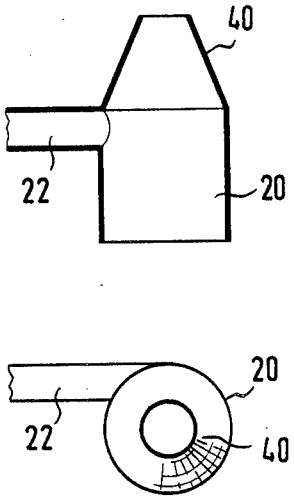
FIG. 5*b* is a vertical section and a plan view of a further modification of the deflection space.
Figure 5C:
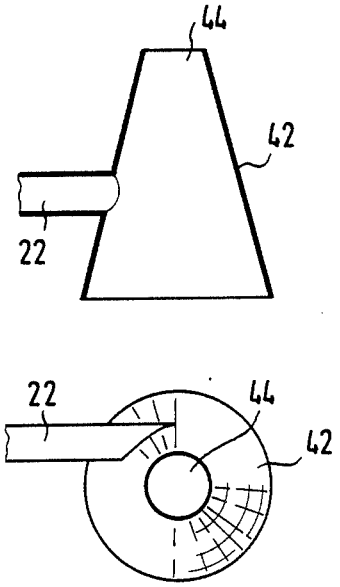
FIG. 5*c* is a vertical section and a plan view of a further modification of the deflection space.

FIGS. 5*a* to 5*c* show various embodiments of the deflection space. In the embodiment according to FIG. 5*a* the cylindrical deflection space 20 is provided with a closed pointed roof 38 so that no tobacco particles or impurities can deposit on the deflection space.

Finally, FIGS. 5*b* and 5*c* show embodiments of deflection space 20 which are open at the top. By appropriate adaptation of the dimensions, pressures and flow velocities it can be ensured that in this case as well the gas phase and the tobacco particles are withdrawn downwardly from the deflection space 20. Sediments on the deflection space can be largely avoided by this modification.

FIG. 5*b* shows an embodiment in which the cylindrical deflection space 20 is followed upwardly by a funnel-shaped region 40 which is provided at its upper end with a cleaning opening so that the interior of the deflection space 20 is freely accessible, in particular for cleaning purposes.

FIG. 5*c* shows an embodiment of the deflection space which has inclined inwardly extending side walls 42 over its entire height and is likewise provided at its upper end with a cleaning opening 44. This results in a smooth inner wall of the deflection space 42 so that the depositing of tobacco particles or soiling can be largely avoided.

Figure 6:
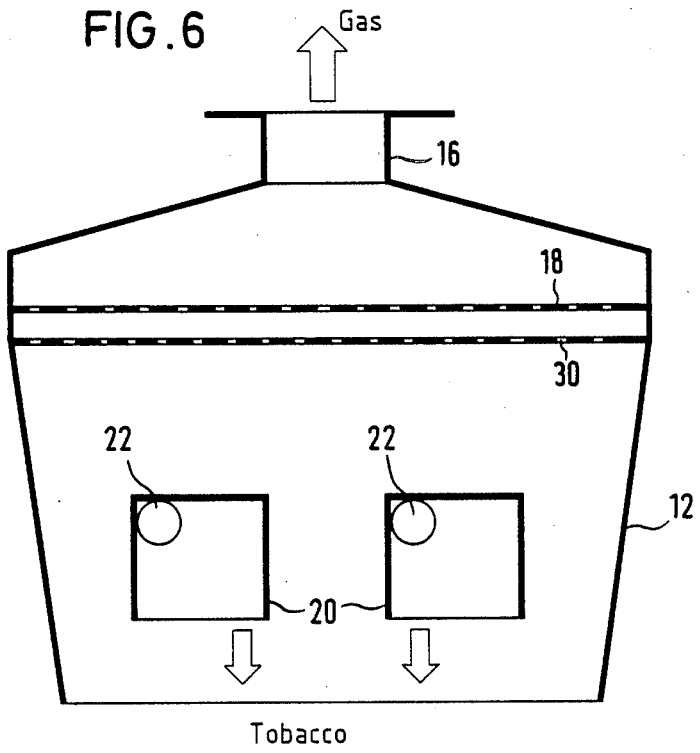
FIG. 6 is a vertical section through a separator having two deflection spaces parallel to each other.
Figure 7:
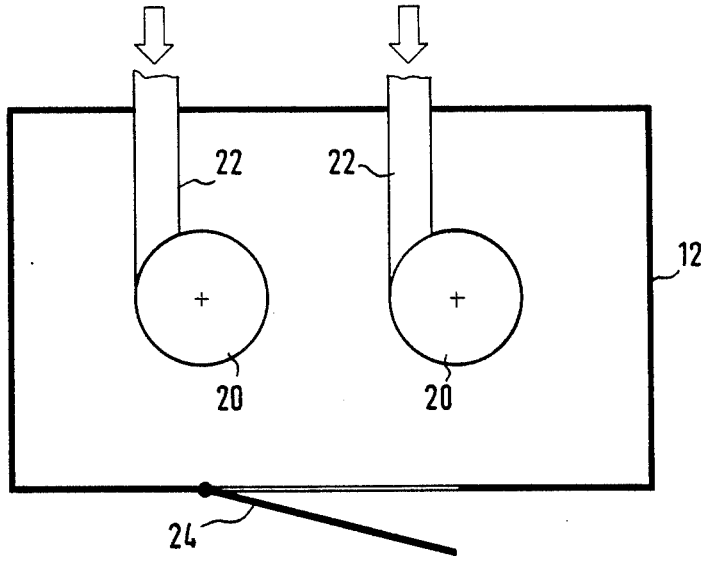
FIG. 7 is a horizontal section through the separator according to FIG. 6.

FIGS. 6 and 7 show an embodiment of a separator which differs from the embodiments discussed so far in that in the hood 12 two deflection spaces 20 are arranged horizontally adjacent to each other. Each deflection space 20 is provided with an associated transport conduit 22 for the supply of the tobacco/gas mixture.

In this manner two separate mixture streams can be processed simultaneously, one gas stream and one tobacco stream being generated.

Due to the size of the dischargeing transport systems it may be expedient to taper the hood 12 downwardly as shown in FIG. 6.

Figure 8:
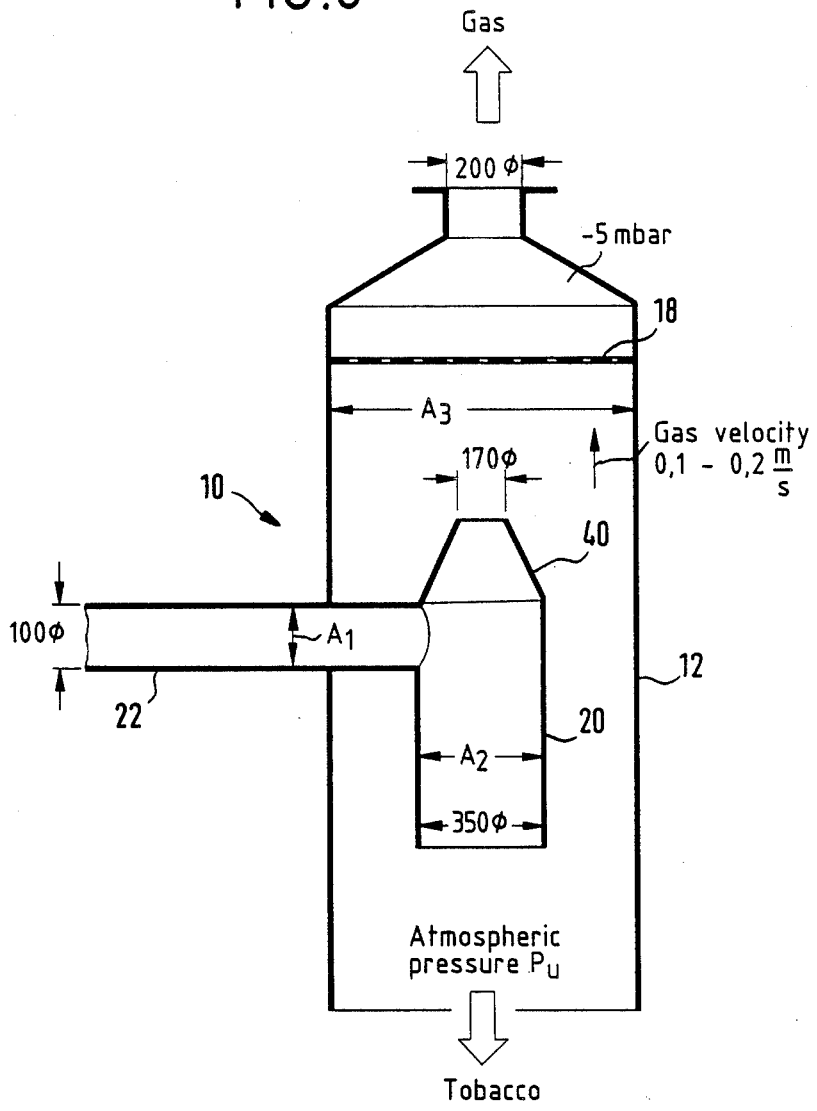
FIG. 8 is a vertical section through an embodiment of the separator with indication of the dimensions.

Finally, FIG. 8 shows an embodiment of the separator 10 corresponding to FIG. 1 and 2 but with a deflection space 20 corresponding to FIG. 5*b*.

In this Figure the dimensions and the operating conditions implemented in a production plant have been entered. 1500 kg tobacco per hour was processed with a gas or vapour mass flow of 100 kg/hour. The inlet velocity of the tobacco/gas mixture was of the order of magnitude necessary for the pneumatic transport at about 20 m/s.

The velocity of the upwardly withdrawn gas was between 0.1 and 0.2 m/s, for which purpose a reduced pressure of 5 mbar was maintained in the upper funnel-shaped end region of the hood 12.

The tobacco particles dropped out of the lower open end of the hood 12, maintained at ambient pressure $p_u$.

The inlet 22 for the tobacco/gas mixture had an area with the size $A_1=0.008\ m^2$; the deflection space 20 formed by a cylinder had an area with the size $A_2=0.1\ m^2$; finally the hood 12 had an area with the size $A_3=1.4\ m^2$.

To achieve the desired gravity separation values other than the latter may be adopted; however, certain limit values for the area ratios must be observed, i.e.

$$5 \leqq A_2/A_1 \leqq 30 \text{ and}$$

$$A_3/A_1 \geqq 50$$

Particularly good results are achieved when the ratio $A_2/A_1$ lies between 10 and 20 and the ratio $A_3/A_1$ is greater than 100 but less than 200.

We claim:

1. A separator for separating tobacco particles from a fluid tobacco and gas mixture comprising: a hood, a circular deflection space arranged in the hood, said circular deflection space being formed by an upwardly closed and downwardly open cylinder providing a downwardly directed outlet for said tobacco particles and said gas, an inlet for the fluid tobacco and gas mixture to be separated opening into the circular deflection space, a conduit for delivering said fluid tobacco and gas mixture through said inlet in a path with a radially outer portion of said fluid mixture tangentially contacting and following a curved interior surface of said cylinder, an outlet for the tobacco particles at the lower end of the hood and an outlet for withdrawing said gas above the deflection space, wherein the ratio of the area ($A_2$) of the deflection space to the area ($A_1$) of the inlet is between 5 and 30, and the ratio of the area ($A_3$) of the hood to the area ($A_1$) of the inlet is greater than 50.

2. A separator according to claim 1, wherein the size ratio of the area ($A_3$) of the hood to the area ($A_1$) of the inlet is greater than 100 but less than 200.

3. A separator according to claim 1, wherein the size ratio of the area ($A_2$) of the deflection space to the area ($A_1$) of the inlet is between 10 and 20.

4. A separator according to claim 1, wherein a plurality of said deflection spaces with associated inlets is provided in one hood.

5. A separator according to claim 1, wherein the lower end of the hood is open.

6. A separator according to claim 1, wherein a discharge member is integrated into the lower end of the hood.

7. A separator according to claim 6, wherein said discharge member is a conveying screw or a rotary vane lock.

8. A separator according to claim 1, wherein a flow resistor is provided in the upper region of the hood.

9. A separator according to claim 8, wherein the flow resistor is formed by a perforated metal sheet having holes distributed uniformly over its area.

10. A separator according to claim 1, wherein a sieve is disposed in the upper region of the hood.

11. A separator according to claim 1, wherein said hood includes an external wall and further including heating means disposed in said wall.

12. A separator according to claim 1, wherein the deflection space is provided with a pointed roof.

13. A separator according to claim 1, wherein a gas outlet piece is connected to the upper end of the hood and said outlet piece extends in a downwardly inclined direction with respect to a horizontal plane.

14. A separator according to claim 1, wherein the hood has a regular cross-section.

15. A separator according to claim 14, wherein the hood has a circular cross-section.

16. A separator according to claim 14, wherein the hood has a rectangular cross-section.

17. A separator for separating tobacco particles from a fluid tobacco and gas mixture comprising: a hood, a circular deflection space arranged in the hood, said circular deflection space being formed by a downwardly open cylinder providing a downwardly directed outlet for said tobacco particles, an upper end of said cylinder being partially closed by an upwardly open cone, an inlet for the fluid tobacco and gas mixture to be separated opening into the circular deflection space, a conduit for delivering said fluid tobacco and gas mixture through said inlet in a path with a radially outer portion of said fluid mixture tangentially contacting and following a curved interior surface of said cylinder, an outlet for the tobacco particles at the lower end of the hood and an outlet for withdrawing said gas above the deflection space, wherein the ratio of the area ($A_2$) of the deflection space to the area ($A_1$) of the inlet is between 5 and 30, and the ratio of the area ($A_3$) of the hood to the area ($A_1$) of the inlet is greater than 50.

18. A separator for separating tobacco particles from a fluid tobacco and gas mixture comprising: a hood, a circular deflection space arranged in the hood, said circular deflection space being formed by as vertically oriented cone having an upper opening and a bottom opening, said bottom opening being larger than said upper opening and providing a downwardly directed outlet for said tobacco particles, an inlet for the fluid tobacco and gas mixture to be separated opening into the deflection space, a conduit for delivering said fluid tobacco and gas mixture through said inlet in a path with a radially outer portion of said fluid mixture tangentially contacting and following a curved interior surface of said cone, an outlet for the tobacco particles at the lower end of the hood and an outlet for withdrawing said gas above the deflection space, wherein the ratio of the area ($A_2$) of the deflection space to the area ($A_1$) of the inlet is between 5 and 30, and the ratio of the area ($A_3$) of the hood to the area ($A_1$) of the inlet is greater than 50.

* * * * *